US005418057A

United States Patent [19]

Tokiyoshi et al.

[11] Patent Number: 5,418,057

[45] Date of Patent: May 23, 1995

[54] THERMAL TRANSFER RECEIVING PAPER

[75] Inventors: Tomofumi Tokiyoshi, Souka; Hiromasa Kondo; Osamu Kitao, both of Urawa; Hiromichi Yasuda, Takarazuka, all of Japan

[73] Assignee: New Oji Paper Co., Ltd., Tokyo, Japan

[21] Appl. No.: 215,340

[22] Filed: Mar. 21, 1994

[30] Foreign Application Priority Data

Mar. 26, 1993 [JP] Japan ..... 5-068289
Mar. 26, 1993 [JP] Japan ..... 5-068662

[51] Int. Cl.[6] ..... B41M 5/025; B41M 5/26

[52] U.S. Cl. ..... 428/323; 428/195; 428/207; 428/211; 428/342; 428/537.5; 428/913; 428/914

[58] Field of Search ..... 8/471; 428/195, 913, 428/914, 484, 488.1, 488.4, 207, 211, 323, 342, 537.5; 503/227

[56] References Cited

U.S. PATENT DOCUMENTS 4,639,751 1/1987 Mori et al. ..... 346/227
5,169,468 12/1992 Royce et al. ..... 156/234

*Primary Examiner*—B. Hamilton Hess
*Attorney, Agent, or Firm*—Morgan & Finnegan

[57] ABSTRACT

A thermal transfer receiving paper has an image-recieving layer receiving a thermal melting ink on a base paper containing pulp fibers as the main component. The image-receiving layer is formed by coating or impregnating a coating composition containing a synthetic polymer resin on one surface of the base paper. The synthetic polymer resin has a glass transition point of −60° to −5° C. and a surface tension of 38 to 55 dyne/cm. The pulp fibers constituting the base paper preferably containes at least one unbeaten pulp fiber in an amount of 50 to 100 weight % based on the total pulp fibers, which has a degree of water retention of not higher than 125% in accordance with J. TAPPI No.26, and satisfies the following equesions (1) and (2):

$$0.3 \leqq L \leqq 1.0 \quad (1)$$

$$0.3 \leqq d/D \leqq 0.8 \quad (2)$$

where

L: Length weighted mean fiber length (mm) measured in accordance with J.TAPPI No. 52

D: Mean fiber diameter (μm) measured by microphotography d: Mean lumen diameter (μm) measured by microphotography.

Further it is preferred that the coating composition further contains a porous pigment having an apparent specific gravity of 0.1 to 0.5 g/cm$^3$ according to JIS K-6220.

7 Claims, No Drawings

THERMAL TRANSFER RECEIVING PAPER

BACKGROUND OF THE INVENTION

The present invention relates to a thermal transfer receiving paper used in copier, printers and facsimiles by utilizing the thermal transfer method of thermal melting ink type. More particularly, it relates to a thermal transfer receiving paper useful for the cards or labels requiring high speed printing and high speed reading, such as passenger tickets, passes, airway tickets, POS labels, prepaid cards and the like.

Recently, accompanied with rapid developments in office automation and factory automation, copier, printers and facsimiles utilizing various recording methods such as electrography method and thermal transfer method have been used depending on each applications and, for example, widely used in CAD/CAM. Color materials are used for printing image in such a thermal transfer method and usually a color material is molten, vaporized or sublimed and transferred on a recording medium such as image-receiving paper, e.g., paper or film and thus an image is recorded on it by adhesion, adsorption or dyeing.

Among these recording methods, a thermal melting transfer method in which an ink film having a thermal melting ink layer constituted by color materials and waxes or resins is molten by the heat of a thermal head and the color material is transfered on a thermal transfer receiving paper to prepare a recorded image is noticed to be utilized in card papers such as passenger tickets, passes and airway tickets, labels such as POS labels and cards such as prepaid cards requiring reliability and security as it has advantages such that it requires only simple and compact equipments and is maintenance free. The thermal melting transfer method also has a feature that it can use plain papers as the recording medium.

However, even such thermal transfer method cannot give a satisfactory result when a plain paper is used as demands for full-color printing, high speed printing, clear image printing and higher resolution have been increased together with the improvement in the performance of the printing equipment in the same manner as in the other printing methods. For example, when the bar code on a label printed at high speed is read by a reader, if the image quality is poor and many missing of dots and discontinuity of line are observed, the bar code cannot be read in high precision and such a thermal transfer receiving paper fails. In tickets and cards combined with magnetic recording method, as the card is passed through an equipment including a magnetic head at a high speed and is used repeatedly for a long period, transferability and fastness become issue when the image transferred on the thermal transfer receiving paper is stained by rubbing and the ink is imperfectly transferred and the card becomes failed in its role.

For the purpose, a number of proposals has been made on the thermal transfer receiving paper. For example, they include a method in which the Beck smoothness of the surface of the image-receiving layer is specified (Japanese Laid-Open Patent Publication Nos. 133092 of 1982 and 187892 of 1984), a method in which a image-receiving layer containing specified emulsions and latices is provided (Japanese Laid-Open Patent Publication Nos. 158297 of 1986 and 158498 of 1986) and a method in which a image-receiving layer containing a specified pigment and binders such as polyvinyl alcohol and latex is provided (Japanese Laid-Open Patent Publication Nos.110489 of 1985, 192690 of 1985, 217289 of 1986, 266296 of 1986, 284486 of 1986, 32085 of 1987, 257888 of 1987 and 202293 of 1989). However, these conventional methods could not attain completely the improvement in ink transfer. Thus, they include difficulties including poor in representativity of edges of images and lack in the sharpness of images, peeling of the surface of the imaging layer together with the transfer ink by the pick during separating the ink film with the thermal transfer receiving paper in the thermal transfer process causing imperfect transfer of ink and discontinuity of line. Thus, at present no satisfactory printed image is yet obtained.

Also, recently gravure and offset printings are frequently made on the thermal transfer receiving paper and consequently the demands on the qualities such as smoothness and surface strength of the thermal transfer receiving paper and opacity have become more strict. Furthermore, there are troubles such as deterioration of the image quality due to the paper dust formed from the thermal transfer receiving paper and paper feeding or delivery trouble in the printer. The measures for eliminating these troubles are the pressing need of the hour.

An object of the present invention is to provide a thermal transfer receiving paper of high quality and high image quality which gives no transfer unevenness, nor discontinuity of line nor imperfect transfering of ink and is excellent in transferability and fastness of transferred image and has an excellent high speed printability to say nothing of full-color printing and also has an excellent printability.

SUMMARY OF THE INVENTION

In the thermal transfer receiving paper of the invention, a coating composition containing a synthetic polymer resin is coated or impregnated on one surface of a base paper containing pulp fibers as the main component to provide an image-receiving layer receiving a thermal melting ink. The synthetic polymer resin has a glass transition point of −60° to −5° C. and a surface tension of 38 to 55 dyne/cm.

Preferably, the pulp fibers constituting the base paper containes at least one unbeaten pulp fiber in an amount of 50 to 100 weight % based on the total pulp fibers, which has a degree of water retention of not higher than 125% in accordance with J. TAPPI No. 26, and satisfies the following equesions (1) and (2):

$$0.3 \leqq L \leqq 1.0 \quad (1)$$

$$0.3 \leqq d/D \leqq 0.8 \quad (2)$$

where

L: Length weighted mean fiber length (mm) measured in accordance with J.TAPPI No. 52

D: Mean fiber diameter (μm) measured by microphotography d: Mean lumen diameter (μm) measured by microphotography.

The image-receiving layer may contains a porous pigment having an apparent specific gravity of 0.1 to 0.5 g/cm$^3$ in accordance with JIS K-6220. In the case, the weight ratio of the synthetic polymer resin to the porous pigment contained in the image-receiving layer is preferably 20–150:100.

DETAILED DESCRIPTION OF THE INVENTION

We, inventors, have investigated on the thermal transfer receiving paper of high image quality which can improve the tendency to closely contact the ink film with the imaging surface and gives no transfer unevenness nor missing of dots and is excellent in ink transfer. As the result, we have found that a significant effect which could not be presumed from the conventional technologies could be attained by forming a image-receiving layer or ink-receiving layer containing a specified synthetic polymer resin on one surface of a base paper in order to get the desired effect and have completed the present invention.

The important requirements for the synthetic polymer resin used in the coating composition of the image-receiving layer in the present invention are that it has a glass transition point (referred to as $T_g$ hereinafter) of −60° to −5° C. and a surface tension (referred to as $\gamma$ hereinafter) of 38 to 55 dyne/cm. Thus, since the image-receiving layer in the invention is formed as a relatively soft film of the above specific synthetic polymer resin, the surface of the image-receiving layer is properly plasticized (heat transferred) by the heat coming from the thermal head to enhance the affinity to the transfer ink, and the wetting property of the surface of the image-receiving layer is very improved. Resultantly, the transfer ink molten by the thermal head properly penetrates into the image-receiving layer to remarkably improve the ink transferability. Generally, since the period when the thermal melting components (waxes) in the ink film are molten is very short in high-speed printing, the penetration of the transfer ink into the image-receiving layer tends to be insufficient. However, the product of the invention is satisfactorily used even if the thermal transfer printing is carried out at a high speed of not lower than 4 inches/sec.

$T_g$ of the synthetic polymer resin can be properly adjusted depending on the type of the constitutional monomers, the composition, the constitutional ratio (degree of copolymerization) and the polymerization conditions such as polymerization temperature.

For example, $T_g$ of polybutadiene is about −90° C., that of polyisobutylene is about −73° C., that of polystyrene is about 90° C., that of polymethyl methacrylate is about 105° C., that of polybutylacrylate is about −55° C. and that of polyethylene is about −125° C. as well known. The $T_g$ can be also adjusted properly by preparing a copolymer by combining properly the constitutional monomers and by adjusting the polymerization temperature. For example, a styrene-butadiene copolymer latex is excellent in the printing strength and the print gloss and thus widely used as a paper coating binder in the paper industry. Usually, the $T_g$ of such a binder is 0° to 60° C. in many cases.

On the other hand, the surface tension ($\gamma$) of the synthetic polymer resin depends on, for example, the condition of the protective layer formed by an adsorption or a chemical linkage of the surface active agent or the protective colloid (water-soluble polymer) used as the emulsifier for the emulsion polymerization on the particle surface of the synthetic polymer resin, or the remained amount (concentration) of the emulsifier isolated with no adsoption to the particle surface. Of course, the $\gamma$ of the synthetic polymer resin can be also adjusted by the polymerization conditions and the particle size, the type and the amount of the emulsifier and also an addition of water-soluble salts.

In the invention, if the $T_g$ of a synthetic polymer resin exceeds −5° C., the affinity to the ink on the image-receiving layer surface is poor and thus missing of dots and discontinuity of line are observed and the dot representativity is poor and the sharpness of the line portion becomes deteriorated. In addition, imperfect transfering of ink and staining by rubbing tend to occur to give poor transferability and low fastness. On the other hand, a $T_g$ of lower than −60° C. causes blocking of the imaging paper and bleeding of the ink and poor printability due to the decrease in the surface tension unfavorably.

In the case the $\gamma$ of the synthetic polymer resin is lower than 38 dyne/cm, the wetting property of the surface to the transfeted ink of the image-receiving layer is lowered and poor ink transfer and migration of ink on the surface of the image-receiving layer may occur and thus the quality of the resultant image is remarkably deteriorated. On the other hand, when it exceeds 55 dyne/cm, the ink tends to spread and blot to form imperfect transferred image, though the transfer property of the ink is enhanced. In addition, no coating composition of good coatability can be prepared as the dispersion stability of the synthetic polymer resin is rapidly lowered. From the above, the $T_g$ of the synthetic polymer resin is specified to be −60° to −5° C., preferably −55° to −10° C., and the $\gamma$ of it is specified to be 38 to 55 dyne/cm, preferably 40 to 50 dyne/cm.

The synthetic polymer resin is not particularly restricted and may be used in the form of a latex or emulsion. As the useful synthetic polymer resins, there are exemplified synthetic rubber type polymer resins such as styrene/butadiene copolymer, methacrylate/butadiene copolymer, polybutadiene, polyisobutylene and polychloroprene; acrylic resins such as methacrylate/acrylate copolymer, ethylacrylate/acrylate copolymer, styrene/acrylate copolymer and polyacrylate; vinyl acetate resins such as ethylene/vinyl acetate copolymer, maleate/vinyl acetate copolymer, ethylacrylate/vinyl acetate copolymer and polyvinyl acetate; vinyl chloride resins, vinylidene chloride resins, and various modified polymers prepared by introducing functional groups such as carboxyl group, hydroxyl group, amide group and amino group to these polymers or the copolymers, and polyethylene, polystyrene, polyisoprene and the like. At least one of them are properly selected for use according to the aimed quality of the thermal transfer receiving paper. Among these synthetic polymer resins, the synthetic rubber latex is especially preferably used as it is excellent in the improvement in adhesion strength of the image-receiving layer surface and the dispersion stability of the pigment and forms a soft and highly elastic film to exert excellent effect on the transferability of the transfer ink and the representativity of the dot shape.

Furthermore, a water-soluble or water-dispersible polymer compound can be used if required in combination in addition to the synthetic polymer resin specified above. In order to get the desired effect according to the invention, it is preferable that at least a specified synthetic polymer resin is contained in an amount of not less than 70 weight %, preferably not less than 75 weight %, based on the total solid of the synthetic polymer resin.

The water-soluble or water-dispersible polymer compounds mentioned above include, for example, starches such as cationic starch, amphoteric starch, oxidized starch, enzyme-modified starch, thermochemically modified starch, α-starch, esterified starch and etherified starch; cellulose derivatives such as carboxymethyl cellulose and hydroxyethyl cellulose; natural and semi-synthetic poymer compounds such as natural rubber, gelatin, casein and soya protein; synthetic polymer compounds such as polyvinyl alcohol, polyvinyl pyrrolidone, polyethyleneimine, polyether, polyurethane, polyamide, olefine/maleic anhydride resin, polyamide/epichlorohydrin resin, polyester resin, epoxy resin and melamine resin. In addition to them, various additives such as surfactants, pH adjusters, viscosity controllers, softening agents, gloss agents, waxes, dispersants, fluidity modifiers, conductivity agents, stabilizers, antistatic agents, croslinking agents, sizing agents, fluorescent brighteners, coloring agents, ultraviolet absorbers, defoamers, water-proofing agents, plasticizers, lubricants, perservatives and perfumes can be properly used if required.

The amount of the coating composition to be coated or impregnated is preferably 1 to 5 g/m$^2$, more preferably 1.5 to 4.5 g/m$^2$, on one side on dry basis. An amount lower than 1 g/m$^2$ hardly gives the desired effect of the present invention, while that higher than 5 g/m$^2$ tends to cause blocking of the image-receiving layer surface unfavorably.

In the invention, the quality characteristic as a thermal transfer receiving paper can be preferably further improved by adding at least one porous pigment having an apparent specific gravity of 0.1 to 1.0 g/cm$^3$ according to JIS K-6220 referred simply to as apparent specific gravity hereinafter) in the image-receiving layer. The porous pigment contains a large amount of air in its particles. Accordingly, proper voids and cushioning property can be provided by including such pigment in the image-receiving layer favorably so that the insulating feature of the image-receiving layer can be maintained well and the heat coming from the thermal head can be held properly on the image-receiving layer surface. As the result, the receiving property of the transfer ink and the clearness of the recorded image are remarkably improved and further the transfer unevenness and the missing of dots are also highly improved. Thus, the quality characteristics as a thermal transfer receiving paper is remarkably improved.

The methods for the measurement of the apparent specific gravity of a pigment include one in which the "volume" specified in JIS K-5101 is measured and it is converted to a bulk specific gravity, or the bulk density (ml/g) is converted to the apparent density (g/cm$^3$). However, we, inventors, have investigated and have found that the apparent specific gravity measured by applying a given load on the pigment defined by JIS K-6220 to a somewhat dense condition has a higher correlation to the effect desired by the invention in the case of the thermal transfer receiving paper of the invention in which a coating composition containing a porous pigment is coated to form an image-receiving layer or it is further passed though a press nip to smoothen it.

The Apparent Specific Gravity is measured in accordance with JIS K 6220 as follows:

In the first, a hollowed piston having an outside diameter of 21.80±0.05 mm, a length of 115 mm and a mass of 190 g is correctly put into a cylinder having an inside diameter of 22.00±0.05 mm and an inside depth of 100 mm, and allowed to sink naturally. Finally, the length of the projecting part accurate to 0.01 cm is measured.

Next, the piston is drawn out. About 1 to 5 g of the sample accurate to 0.1 g is weighed and gently poured in the cylinder. The cylinder is lightly shaken or given little knocks to let fall the sample adhering to the cylinder wall and at the same time to make the upper surface of the contents flat. Then the piston is correctly and gradually fallen in the cylinder with fingers. The time required by the piston to reach the sample surface shall be 5 sec., as a rule.

When the piston has reached the sample surface, this procedure is finished by giving the piston one turn lightly by fingers or beating the cylinder wall lightly with a piece of wood to settle the piston well.

The length of the part of the piston extruding above the cylinder is measured and the apparent specific gravity by the equation below.

$$G = \frac{S}{(H_2 - H_1) \times 0.7854D^2}$$

where

G: apparent specific gravity (g/cm$^3$)

S: mass of sample (g)

$H_2$: length of the part of piston extruding above cylinder where sample is present (cm)

$H_1$: length of the part of piston extruding above cylinder where sample is absent (cm)

D: inside diameter of cylinder (cm).

The porous pigments are not particularly restricted and those which can be used include, for example, diatomaceous earth, calcinated diatomaceous earth, flux-calcined diatomaceous earth, calcined kaolin, zeolite, white carbon, amorphous silica, magnesium aluminosilicate, fine particle calcium silicate, fine particle alumina, fine particle titanium oxide, fine particle magnesium carbonate and fine particle precipitated calcium carbonate.

When the apparent specific gravity exceeds 0.5 g/cm$^3$, even a porous pigment loses about half of its feature and the voids of the image-receiving layer are decreased to form a denser structure and the insulating efficiency of the image-receiving layer is rapidly reduced. As the result, the receiving property and the transferability of the transfer ink are decreased and a thermal transfer receiving paper excellent in image quality which shows no transfer unevenness nor missing of dots desired by the invention cannot be prepared. On the other hand, when it is lower than 0.1 g/cm$^3$, the voids of the image-receiving layer is increased and the insulating effect comes to excessively higher and thus the heat of the thermal head becomes difficult to be cooled on the image-receiving layer surface and the heat is accumulated and thus blotting of the transfer ink and the bridging of dots are induced to deteriorate the image quality. As the strength of the image-receiving layer surface becomes extremely weak, the image-receiving layer surface is peeled with the transfer ink by the pick caused when separating the ink ribbon from the imaging paper to cause the lowering of the image quality by the imperfect transferring of ink. So, it is preferred the apparent specific gravity is 0.1 to 0.5 g/cm$^3$, more preferably 0.15 to 0.45 g/cm$^3$, and most preferably 0.20 to 0.40 g/cm$^3$.

In order to get the effect desired by the invention, the weight ratio of the specified synthetic polymer resin to the porous pigment is preferably 20 to 150:100, more preferably 25 to 125:100. When the ratio is less than 20:100, the strength of the image-receiving layer becomes very poor to cause imperfect transferring of ink and to form paper powder easily and thus to deteriorate the image quality. Contrary to it, when the ratio is more than 150, it causes blocking on the image-receiving layer surface and low sharpness of the line part of the image unfavorably.

The pigments other than the porous pigments may be added in the coating composition. Among the pigments, there are included various pigments used for usual coated paper, such as mineral pigments, e.g., kaolin, delaminated kaolin, aluminium hydroxide, satin white, ground calcium carbonate, precipitated calcium carbonate, calcium sulfate, barium sulfate, titanium dioxide, talc, zinc carbonate, alumina, magnesium oxide, magnesium carbonate, silica, colloidal silica, bentonite, zeolite and celisite, and organic pigments, e.g., fine particles and fine hollow particles of polystyrene resin, urea resin, melamine resin, acrylic resin and benzoguanamine resin and others. The ratio of the above pigment other than the porous pigment incorporated is up to 30 weight % based on the porous pigment to get the desired effect of the invention.

The coating amount of the coating composition containing the specified synthetic polymer resin and the porous pigment according to the invention is preferably 5 to 25 g/m$^2$, more preferably 6 to 20 g/m$^2$, on one side on dry basis. When the amount is less than 5 g/m$^2$, it is difficult to obtain the desired effect of the invention. On the other hand, an amount higher than 25 g/m$^2$ tends to cause blocking on the image-receiving layer surface and also to cause deterioration of image quality by the blotting of ink unfavorably.

In the methods for the coating and the impregnation, there can be used generally known equipments including, for example, a blade coater, an air knife coater, a roll coater, a reverse roll coater, a bar coater, a champflex coater, a curtain coater, a die slot coater, a gravure coater, a brush coater, a two-roll or metering type size press coater, a short dwell coater, a bill blade coater, a gate roll coater and a spray coater. These equipments may be used in any form of on-machine coater or off-machine coater.

In forming the image-receiving layer, it is also possible to prepare the image-receiving layer as a structure of monolayer or, if required, of at least two layers. When it is made to be multilayer structure, each coating compositions are not necessary to be identical to each other and they can be properly controlled according to the desired quality level and are not particularly restricted. It is also possible to provide a synthetic resin layer, a coating layer consisting of a pigment and an adhesive or an antistatic layer, etc. on the back of the base paper to improve curling, printability and paper feeding or deliverability.

The method for the preparation of base paper which is the substrate for the invention cannot be also overlooked in order to obtain a thermal transfer receiving paper excellent in printability aimed by the invention.

The base paper which is the substrate for the invention is prepared by properly adjusting the type of the raw material pulp, its method for the preparation, the type of the beater and the beating condition, additives, the paper-making method, and the after-treating methods including calendering. Among these conditions, the type and the property of raw material pulp are particularly important factors to get the smoothness of the base paper. For example, though the smoothening of the paper surface can be attained to some extent by the supercalendering treatment in the aftertreatment step, it is difficult to give a thermal transfer receiving paper of high quality which shows a sharp image and free from transfer unevenness depending on the type and the property of the pulp.

In the invention, to improve the tendency to contact the ink film with the imaging surface and to give the desired effect on the imaging paper which gives no transfer unevenness nor missing of dots and is excellent in ink transferability and gives a thermal transfer printing of high image quality, a specified pulp fiber is used to give cushioning property and smoothness to the base paper and a specified ink image-receiving layer is formed on the base paper to afford a more marked effect by the synergism between the base paper characteristics by using the specified pulp fiber and the specified ink image-receiving layer characteristics.

The degree of water retention is an important property for the pulp used in the invention. The degree of water retention means the amount of water held by a defined amount of pulp fiber and is a quantitative measure of the swollen condition and the porosity of the pulp. Practically, it is a value measured by a method according to J.TAPPI No. 26 and called WRV ["water retention value" described in "Tappi" Vol. 43. No.5, 505–512 (1960)]. A usual pulp is prepared by using lignocellulose fibers such as wood, straw, bagasse, bamboo and Kenaf as the raw materials and treating them by a digesting step and a bleaching step. Generally, the degree of water retention of a pulp fiber after bleached is 125 to 200% though depending on the type of the raw material and the method for the preparation of the pulp.

Almost all of the unbeaten pulp fibers used in the invention is specified to those having a degree of water retention not higher than 125% and they are pulp fibers of extremely low swelling. As such pulp fibers permeate a very small amount of water into the fiber wall, they are low in expansion and contraction changes due to absorption or desorption of water. It was found that such a fact acts advantageously to the improvement in dimensional stability and also gives proper voids and cushioning property to the base paper as the binding strength between fibers is relatively small and the contact points between fibers is litle. Furthermore, it was found that, when a base paper is prepared by using a pulp fiber of such property, the insulating characteristic is highly improved and the heat from the thermal head can be stored properly on the surface of the image-receiving layer to remarkably improve the quality characteristics as a thermal transfer receiving paper.

In order to prepare such a pulp fiber, the type and the method for the preparation are not particularly restricted and exemplified are dry pulp prepared by a procedure in which a slurry pulp or a paste-like pulp (wet pulp) prepared through a digesting step and a bleaching step is dried once to a sheet by using a drier and a recovered paper pulp which have been made into a paper through a paper-making step at least once and then dried.

In the case the degree of water retention of the pulp fiber specified by the present invention exceeds 125%, the voids and the cushioning property in the paper layer are gradually lost as the value becomes high to deteriorate the heat insulating effect. As the result, in the thermal transfer receiving paper finished by using such a pulp, not only a desired image receiving layer in which a sharp image of high quality with no missing of dots can be printed is not formed, but also the degree of expansion and contraction of the paper becomes high to tend to cause curling and to cause running trouble in the printer. Contrary to it, a too low degree of water retention causes formation of too many voids in the paper layer and lowers the binding strength between fibers extremely and thus lowers the paper layer strength and forms paper dust. As the result, it is feared that the image representativity is lowered and discontinuity of line in the line portion can occur by the picking and further it is presumed the printing effect is also lowered unfavorably. Therefore, the degree of water retention of the pulp fiber is preferably not higher than 125%, more preferably 75 to 120%.

In the preparation of base paper, usually a wet pulp is fed to the wire part of a paper-making machine as a paper material and finished as a paper sheet through the paper-making step. In this case, the method for preparing the paper material include a procedure in which a wet pulp (a slurry prepared by digesting once the pulp in the case of a dry pulp) is beaten as required by beaters of various refiners to give proper paper layer strength and smoothness when finished to a paper material and, if required, various additives, dyestuffs and fillers are added to the pulp slurry properly and a paper material (pulp slurry) is thus prepared to a concentration of 0.3 to 1 weight %.

In the case of a conventional thermal transfer receiving paper, the pulp fiber constituting the substrate, the base paper, has usually a degree of water retention of 160 to 300 after the beating step. Contrary to it, we, inventors, have investigated on the features of the pulp fiber to obtain the aimed effect of the invention. As the result, we have found that the degree of water retention before the beating step is a very important factor.

Thus it is important that the degree of water retention at the time it is digested (before beating) not higher than 125% measured by a method according to J.TAPPI No. 26. Of course, in the preparation of a paper material, the pulp is beaten by a beater as mentioned above. However, if an excessive beating is made, even a specific pulp fiber as mentioned above may lose its original features and can fail to exert the desired function. Hence, it is preferred to control the degree of water retention of the pulp fiber after beaten at a level not higher than 180%, preferably 90 to 160%.

In addition, it is important that the unbeaten pulp fiber specified above satisfies the equations (1) and (2) at the same time. By using a pulp fiber satisfying the conditions, a base paper having a relatively bulky paper layer structure and an excellent cushioning property and being uniform and having a high smoothness can be efficiently prepared.

$$0.3 \leqq L \leqq 1.0 \quad (1)$$

$$0.3 \leqq d/D \leqq 0.8 \quad (2)$$

where

L: Length weighted mean fiber (mm) length measured in accordance with J.TAPPI No. 52

D: Mean fiber diameter (μm) measured by microphotography d: Mean lumen diameter (μm) measured by microphotography.

The pulp fibers satisfying the bove equations (1) and (2) include, for example, chemical pulps prepared by KP, SP and AP processes with use of hardwoods such as maple, oak, Japanese oak, Japanese beech, aspen and eucalyptus as the raw materials. When the length weighted mean fiber length of the pulp fiber (referred to as L value hereinafter) exceeds 1.0 mm, the dispersion of the paper material in the paper-making step becomes poor and a poor formation is resulted and no uniform image-receiving layer surface can be prepared. Contrary to it, a length less than 0.3 mm lowers the paper layer strength extremely and paper powders tend to be formed and can cause a lowering of the image quality due to the paper powder and discontinuity of line in the line portion by the picking. The printability is also deteriorated unfavorably. Therefore, L value is preferably 0.3 to 1.0 mm, more preferably 0.35 to 0.85 mm.

On the other hand, when the ratio of d/D in the equation (2) exceeds 0.8, though the formation becomes good and the smoothness of the paper surface is improved, the paper web tends to crash and the cushioning property of the base paper is lost and it is feared that a sharp image of high quality with no missing of dots desired by the present invention cannot be formed. Contrary to it, when it is lower than 0.3, the fibers change too hard to tend to crash and thus lowering in paper surface smoothness and image quality are feared. In addition, the paper layer strength is also reduced. Therefore, the ratio of d/D is preferably in the range between 0.3 and 0.8, more preferably between 0.35 and 0.75.

The methods for the measurement of pulp fiber length include one by sieving (TAPPI-STD T233 hm-82) and one by projection (TAPPI-STD T232 hm-85). The method for measuring the length weighted mean fiber length according to J.TAPPI No. 52 used in the present invention, however, is different from them and has a high detectability and characterized by that it can measure the fiber length distribution automatical with no influence of width of fiber, thickness of fiber wall and fiber softness and so on. The measured values in each examples of the invention were measured by using Type FS-100 equipment manufactured by Kajaani Co. in Finland.

The mean fiber diameter and the mean lumen diameter were measured by microphotography. In the microphotography, the pulp fiber was wrapped by an acrylic resin and cut into thin pieces by a microtome and 25 fibers of each pieces were measured and their mean values were derived.

It is important that the amount of the above specific pulp fiber contained in the total pulp fibers constituting the base paper is not lower than 50 weight %, more preferably not lower than 60 weight %. In the case lower than 50 weight %, not only no base paper having proper voids and cushioning property desired by the present invention can be obtained but also no sufficient smoothening effect can expected even if the resultant base paper is treated calendering. As the result, an imaging paper of high quality showing no transfer unevenness nor missing of dots desired by the present invention cannot be obtained. From the above, it was found that the effect desired by the invention can be first exerted efficiently when the pulp fiber satisfies all of the specified conditions including degree of water retention, physical properties and amount of components.

From the above, the characteristic of the pulp fiber used for constituting the base paper is one of very important factors in the invention. Even if the degree of water retention is satisfied among the specific requirements of the pulp, the effect tends to be insufficient when both of the above equations (1) and (2) are not satisfied. Therefore, it was first found that the characteristics of the base paper required by the present invention are exerted highly effectively when all of the degree of water retention, the equations (1) and (2) for the fiber properties and the amount of components are satisfied by their synergism.

In the present invention, other chemical pulp fibers can be properly composed if required as far as the above specific pulp fiber is contained in an amount not lower than 50 weight %. Furthermore, mechanical pulps such as SGP, RGP, BCTMP and CTMP, deinked pulps, non-wood pulps such as kenaf, bamboo, straw and jute, organic synthetic fibers such as polyamide fiber, polyester fiber and polynosic fiber, and inorganic fibers such as glass fiber, ceramic fiber and carbon fiber can be also used.

In the present invention, it was found that proper voids, cushioning property and smoothness are efficiently improved by composing 2 to 30 weight %, preferably 4 to 20 weight % of a filler based on the pulp fiber in the paper material preparation and thus including it between the pulp fibers specified above. A thermal transfer receiving paper finished by using the base paper thus prepared shows an especially excellent insulating property and has an excellent quality as a thermal transfer receiving paper to give a more preferred embodiment.

The fillers which can be used are not particularly restricted and include, for example, mineral fillers such as talc, kaolin, calcined kaolin, delaminated kaolin, ground calcium carbonate, precipitated calcium carbonate, magnesium carbonate, titanium dioxide, aluminium hydroxide, calcium hydroxide, magnesium hydroxide, zinc oxide, magnesium sulfate, magnesium silicate, calcium sulfate, calcium silicate, white carbon, aluminosilicates, amorphous silica, celisite, bentonite and smectite; and organic fillers such as fine polystyrene resin particle, fine urea-formalin resin particle and fine hollow particle. Furthermore, the fillers contained in used papers and broke can be also regenerated for use. Among these various fillers, porous fillers having an apparent specific gravity defined by JIS K-6220 of 0.10 to 0.50 g/cm$^3$, more preferably 0.5 to 0.45 g/cm$^3$, can be particularly preferably used as they add the insulating property of the base paper more efficiently.

Various internal additives for paper-making such as anionic, nonionic, cationic or amphoteric retention improvers, paper strength improvers and internal sizes conventionally used can be properly selected for use if required. Also, internal additives for paper-making such as dyestuffs, fluorescent brigtners, pH adjusters, defoamers, pitch controllers and slime controllers can be also properly added if required. Furthermore, the surface can be sized by using adhesives such as starch, polyvinyl alcohol, carboxymethylcellulose, latices and their derivatives or their modified products and various surface sizes, pigments, dyestuffs, fluorescent brigthners, antistatics.

The methods for the paper-making are not particularly restricted and any of all methods including the acid paper-making method carried out at a pH of about 4.5 and so-called neutral paper-making method in which the paper contains an alkaline filler such as calcium carbonate as the main component and the process is carried out at a weakly acid pH of about 6 to a weakly alkaline about 9.

The thermal transfer receiving paper thus prepared is smoothened by the usual drying and surface treating processes and adjusted and finished so that the Z-axis paper strength defined by TAPPI-STD UM403 is 0.05 to 0.18 ft.lb, more preferably 0.08 to 0.16 ft.lb and a moisture content of 3 to 10 weight %, more preferably 4 to 8 weight %.

In the smoothening treatment, an excellent printed image of higher quality required by the invention can be obtained by satisfying the above quality and also by adjusting the 10 points-mean surface roughness ($R_z$) of the imaging paper surface defined by JIS B-0601 to 3 to 15 μm, preferably 5 to 12 μm. When the 10 points-mean surface roughness of the imaging paper surface exceeds 15 μm, the smoothness of the paper becomes inferior and it is feared to cause missing of dots and lowered image quality. On the other hand, when it is smoothened to 3 μm or less, the cushioning property and the insulating property of the base paper are lost and poor transfer of ink, migration of ink on the image-receiving layer surface and shade unevenness tend to occur unfavorably. The transferability of ink is also deteriorated and it tends to cause imperfect transferring of dots by scratch and staining by rubbing.

The 10 points-mean surface roughness defined here was measured at a standard length of 8 mm according to the method specified by JIS B-0601 by using a multipurpose surface structure measuring system SE-3C (manufactured by Kosaka Laboratories Co., Ltd.). Such a method for the measurement of surface roughness is carried out by converting the vertical movement of stylus to an electric value to read the unevenness or smoothness of paper surface. As the result, the minute roughness of the paper surface which had been thought to be difficult to be measured by the common leaking air type smoothness tester such as a Beck smoothness tester and Parker Print Surf could be measured exactly with no influence of air permeability of the paper. In addition, according to our detailed test result, it was clarified that the measurements of the 10 points-mean surface roughness had an extremely higher correlation with the effect of smoothening treatment desired by the invention than the center line-mean surface roughness derived by cutting off the undulation of the imaging paper surface.

The smoothening of the thermal transfer receiving paper is carried out by a common smoothening equipment such as a supercalender, a gloss calender and a soft calender with no special difficulty. A more preferred result can be attained when the paper is passed through a compression nip formed between a metal roll heated to 50° C. or higher, preferably to 80° C. or higher, and a heated or unheated elastic roll for smoothening. It can be also properly used on-machine or off-machine and the shape of the compression equipment and the number of the compression nips can properly controlled in accordance with usual smoothening equipments.

PREFERRED EMBODIMENTS OF THE INVENTION

The following examples serve to illustrate the invention in more detail although the invention is not limited to the examples. Unless otherwise indicated, parts and % signify parts by weight and % by weight, respectively.

[Pulps and Resins]

Pulps ①~⑨ used for preparing base papers in Examples and Comparative Examples are shown in Table 1, and Resins A~L used for preparing coating compositions in Examples and Comparative Examples are shown in Table 2.

TABLE 1

| Pulp No. | Fiber materials | Pulps: Water retention (%) | Mean fiber length L(mm) | Mean fiber dia. D(μm) | Lumen diameter d(μm) | d/D |
|---|---|---|---|---|---|---|
| ① | Eucalyptus | 114 | 0.64 | 18.6 | 8.6 | 0.43 |
| ② | Hemlock fur | 95 | 1.87 | 34.7 | 26.1 | 0.75 |
| ③ | Aspen | 83 | 0.80 | 20.5 | 14.7 | 0.72 |
| ④ | Japanese beech | 106 | 0.73 | 22.3 | 8.1 | 0.36 |
| ⑤ | *Q. acutissima* | 88 | 0.85 | 15.2 | 4.7 | 0.31 |
| ⑥ | Maple | 92 | 0.50 | 19.0 | 10.4 | 0.55 |
| ⑦ | *P. Maximowiczii* | 148 | 0.91 | 26.3 | 19.0 | 0.74 |
| ⑧ | Acacia | 136 | 0.34 | 12.8 | 8.6 | 0.67 |
| ⑨ | Mangrove | 127 | 1.02 | 20.5 | 5.1 | 0.25 |

*1) Water retention (%) of pulp fiber was measured in accordance with J. TAPPI No. 26.
*2) Length weighted mean fiber length (L value; mm) of pulp fiber was measured in accordance with J. TAPPI No. 52.
*3) Mean fiber diameter (D), Mean lumen diameter (d) and d/D value: 25 thin cut pieces of the pulp fiber prepared by a microtome were photographed by a microscope and the mean fiber diameter (D: μm) and the mean lumen diameter (d: μm) were measured to calculate d/D.

TABLE 2

| Resin No. | Glass transition point $T_g$ (°C.) | Synthetic polymer resins: Surface tension γ (dyne/cm) | Composition |
|---|---|---|---|
| A | −36 | 52 | Styrene/butadiene copolymer latex |
| B | −43 | 45 | " |
| C | −25 | 43 | " |
| D | −13 | 47 | " |
| E | −8 | 55 | Acrylate/methacrylate copolymer latex |
| F | +6 | 56 | Styrene/butadiene copolymer latex |
| G | −15 | 36 | " |
| H | −64 | 47 | " |
| J | −5 | 56< | " |
| K | +28 | 54 | " |
| L | −20 | 50 | Acrylate/methacrylate copolymer latex |

*1) $T_g$ was measured by using a differential scanning calorimeter (DSC-10 manufactured by Seiko Instrument Inc.).
*2) γ was measured by using a Du Nouey surface tension balance (manufactured by Taihei Rika Kogyo Co., Ltd. ) in accordance with JIS K-6768. Variously mixed solutions of formamide with ethyleneglycol monoethyl ether were applied to the resin surface and the surface tension (dyne/cm) of the mixed solution with which the resin surface was wetted was measured.

[Apparent specific gravity of porous pigments]

Apparent specific gravity of porous pigments used in Examples was measured in accordance with JIS K-6220-1977.

EXAMPLE 1

[Preparation of a base paper]

To a pulp slurry prepared by mixing 90 parts of LBKP (dry pulp of Pulp ①, freeness=CSF 480 ml) with 10 parts of NBKP (dry pulp of Pulp ②, freeness=CSF 500 ml), 20 parts of talc as the filler (apparent specific gravity=0.75 g/cm$^3$), 2.0 parts of aluminium sulfate, 1.5 part of rosin emulsion size, 1.0 part of cationic starch and 0.2 part of cationic polyacrylamide were added, and they were diluted with white water to prepare a paper material having a pH of 5.2 and a solid content of 1.0%. This paper material was made to a paper by using a twin wire paper-making machine. An oxidized starch was coated on the paper by a size press in an amout of 2 g/m$^2$ on dry basis and then dried and passed through a 3 nip machine calender to prepare a base paper having a metric basis weight of 80 g/m$^2$.

[Preparation of a coating composition]

100 parts (solid basis; same hereinafter) of calcined kaolin (apparent specific gravity=0.34 g/cm$^3$), 0.4 part (dry ratio to the pigment; same hereinafter) of carboxymethyl cellulose and 0.5 part of sodium polyacrylate were mixed together in a Cowles Dissolver. To thus obtained pigment slurry, 70 parts of Resin A, 5 parts of oxidized starch, 1 part of fluorescent brightener and water were added and mixed with stirring to prepare a coating composition having a solid content of 45%.

[Formation of an image-receiving layer]

The resultant coating composition was applied on one side of the above base paper by using a blade coater to a dry coated amount of 15 g/m$^2$ and dried and then smoothened by using a super calender at a nip number of 11, a temperature of the metal roll of 50° C. and a nip linear pressure of 150 kg/cm to prepare a thermal transfer receiving paper having a metric basis weight of 95 g/m$^2$.

EXAMPLES 2 TO 5

Thermal transfer receiving papers were prepared in the same manner as in Example 1 except that the the synthetic polymer resin was varied to respectively Resin B (Example 2), Resin C (Example 3), Resin D (Example 4) and Resin E (Example 5) in the preparation of the coating composition of Example 1.

EXAMPLE 6

A thermal transfer receiving paper was prepared in the same manner as in Example 1 except that 100 parts of amorphous silica (apparent specific gravity=0.20 g/cm$^3$) was used as the porous pigment and the used amount of Resin A was increased to 100 parts to prepare the coating composition of Example 1.

EXAMPLE 7

A thermal transfer receiving papers was prepared in the same manner as in Example 1 except that calcined kaolin (apparent specific gravity=0.42 g/cm$^3$) was used as the porous pigment to prepare the coating composition of Example 1.

EXAMPLES 8 AND 9

Thermal transfer receiving papers were prepared in the same manner as in Example 1 except that a mixed pigment of 75 parts of calcined kaolin and 25 parts of spindle-shaped precipitated calcium carbonate (apparent specific gravity=0.56 g/cm$^3$) was used as the pigment and the used amount of Resin A was changed to 125 parts (Example 8) and 150 parts (Example 9) to prepare the coating composition of Example 1.

EXAMPLE 10

A thermal transfer receiving paper was prepared in the same manner as in Example 8 except that 60 parts of calcined kaolin and 40 parts of spindle-shaped precipitated calcium carbonate were used as the pigments to prepare a coating composition of the coating composition of Example 8.

EXAMPLE 11

A thermal transfer receiving paper was prepared in the same manner as in Example 1 except that the coating amount was changed to 8 gm/m$^2$ on dry basis to form the image-receiving layer of Example 1.

EXAMPLE 12

[Preparation of a base paper]

To a pulp slurry prepared by mixing 95 parts of LBKP (dry pulp of Pulp⑥, CSF 480 ml) with 5 parts of NBKP (dry pulp of Pulp②, CSF 500 ml), 20 parts of a mixed filler of spherical aggregated precipitated calcium carbonate (apparent specific gravity=0.38 g/cm$^3$) with ground calcium carbonate (apparent specific gravity=0.80 g/cm$^3$) in a mixing ratio of 3:2 as the filler, 0.5 parts of aluminium sulfate, 1.5 part of cationic starch, 0.2 part of cationic polyacrylamide and 0.1 parts of an alkylketene dimer were added and they were diluted with white water to prepare a paper material having a pH of 7.9 and a solid content of 1.1%. This paper material was made to a paper by using a Fourdrinier paper-making machine. An oxidized starch and a maleic anhydride surface sizing agent were coated on the paper with a size press in an amount of respectively 2 g/m$^2$ and 0.2 gm/m$^2$ on dry basks and then dried and passed through a 3 nip machine calender to prepare a base paper having a metric basis weight of 75 gm/m$^2$.

[Preparation of a coated composition]

0.2 part of carboxymethyl cellulose and 0.5 part of sodium polyacrylate were added to 100 parts of spherical aggregated precipitated calcium carbonate (apparent specific gravity=0.38 g/cm$^3$) and mixed in a Cowles Dissolver to prepare a pigment slurry. 35 parts of Resin A, 5 parts of polyvinyl alcohol, 1 part of a fluorescent brightner and water were added to the pigment slurry to prepare a coating composition containing 50 weight % of solid.

[Formation of an image-receiving layer]

The resultant coating composition was applied on one side of the above base paper by using a bar coater to a dry coated amount of 20 g/m$^2$ and dried and then smoothened by using a soft calender at a nip number of 4, a temperature of the metal roll of 100° C. and a nip linear pressure of 200 kg/cm to prepare a thermal transfer receiving paper having a metric basis weight of 95 g/m$^2$.

EXAMPLES 13 AND 14

Thermal transfer receiving papers were prepared in the same manner as in Example 12 except that dry pulp of Pulp ④ (Example 13) and wet pulp of Pulp ⑦ (Example 14) were used as LBKP respectively in an amount of 95 parts to prepare the base paper of Example 12.

EXAMPLES 15 AND 16

Thermal transfer receiving papers were prepared in the same manner as in Example 1 except that the coating amount was changed to 5 g/m$^2$ (Example 15) and 25 gm/cm$^2$ (Example 16) on dry weight basis to form the recording of Example 1.

EXAMPLES 17 AND 19

Thermal transfer receiving papers were prepared in the same manner as in Example 1 except that the type of the porous pigment was changed to kaolin (apparent specific gravity=0.58 g/cm$^3$) (Example 17), amorphous silica (apparent specific gravity=0.55 g/cm$^3$) (Example 18) and amorphous silica (apparent specific gravity=0.07 g/cm$^3$) (Example 19) to prepare the coating composition of Example 1.

EXAMPLE 20

Thermal transfer receiving papers were prepared in the same manner as in Example 12 except that the type of the porous pigment was changed to a spindle-shaped precipitated calcium carbonate (apparent specific gravity=0.56 g/cm$^3$) to prepare the coating composition of Example 12.

Comparative Examples 1 to 5

Thermal transfer receiving papers were prepared in the same manner as in Example 1 except that the synthetic polymer resin was changed to Resin F (Comparative Example 1), Resin G (Comparative Example 2), Resin H (Comparative Example 3), Resin J (Comparative Example 4) and Resin K (Comparative Example 5) respectively to prepare the coating composition of Example 1.

Comparative Example 6

Thermal transfer receiving papers were prepared in the same manner as in Example 12 except that the synthetic polymer resin was changed to Resin L to prepare the coating composition of Example 12.

EXAMPLE 21

[Preparation of a base paper]

To a pulp slurry prepared by mixing 90 parts of LBKP (dry pulp of pulp ①, CSF 480 ml) with 10 parts of NBKP (dry pulp of pulp ②, CSF 500 ml), 7 parts of calcined kaolin (apparent specific gravity=0.34 g/cm$^3$), 2.0 parts of aluminium sulfate, 1.2 part of rosin emulsion size and 1.5 part of cationic starch were added as the fillers and they were diluted with white water to prepare a paper material having a pH of 5.2 and a solid content of 0.95%. The paper material was made to a paper by using a Fourdrinier paper-making machine. An oxidized starch and a spindle-shaped precipitated calcium carbonate were coated on the paper by a size press respectively in an amount of 2 g/m$^2$ and 1 g/m$^2$ on dry basis and then dried and passed through a 3 nip machine calender to prepare a base paper having a metric basis weight of 86.5 gm/m$^2$.

[Preparation of a coating composition]

2 parts of a fluorescent brightner and water were added to 100 parts of Resin A and mixed with stirring to prepare a coating composition containing 30% solid.

[Formation of an image-receiving layer]

The resultant coating composition was applied on one side of the above base paper by using an air knife coater in an amount of 3.5 g/m$^2$ on dry basis, dried and then smoothened by using a super calender at a nip number of 11, a temperature of the metal roll of 50° C. and a nip linear pressure of 150 kg/cm to prepare a thermal transfer receiving paper having a metric basis weight of 90 g/m$^2$.

EXAMPLES 22 TO 24

Thermal transfer receiving papers were prepared in the same manner as in Example 21 except that Pulp ③ (Example 22), Pulp ④ (Example 23) and Pulp ⑤ (Example 24) were used as LBKP respectively in an amount of 90 parts to prepare the base paper of Example 21.

EXAMPLE 25

A thermal transfer receiving paper was prepared in the same manner as in Example 21 except that 70 parts of LBKP (dry pulp of Pulp ①, CSF 480 ml), 20 parts of LBKP (wet pulp of Pulp ⑦ CSF 480 ml) and 10 parts of NBKP (dry pulp of pulp ② CSF 500 ml) were used as pulp fibers to prepare the base paper of Example 21.

EXAMPLES 26 TO 29

Thermal transfer receiving papers were prepared in the same manner as in Example 21 except that the synthetic polymer resin was changed to Resin B (Example 26), Resin C (Example 27), Resin D (Example 28) and Resin E (Example 29) to prepare the coating composition of Example 21.

EXAMPLES 30 TO 31

Thermal transfer receiving papers were prepared in the same manner as in Example 21 except thet the coating amount was changed to 2 g/m$^2$ (Example 30) and 6 g/m$^2$ (Example 31) to form the image-receiving layer of Example 21.

EXAMPLE 32

[Preparation of a base paper]

To a pulp slurry prepared by mixing 95 parts of LBKP (dry pulp of Pulp ⑥, CSF 480 ml) with 5 parts of NBKP (dry pulp of pulp ②, CSF 500 ml), 18 parts of a mixed filler of spherical aggregated precipitated calcium carbonate (apparent specific gavity=0.38 g/cm$^3$) with kaolin (apparent specific gavity=0.60 g/cm$^3$) in a mixing ratio of 2:1, 0.5 part of aluminium sulfate, 1.5 part of cationic starch, 0.5 part of cationic polyacrylamide and 0.2 part of an alkylketene dimer were added as the fillers and they were diluted with white water to prepare a paper material having a pH of 7.9 and a solid content of 1.05%. This paper material was made to a paper by using a twin wire paper-making machine to prepare a base paper having a metric basis weight of 86.5 g/cm$^2$.

[Preparation of a coating composition]

15 parts of polyvinyl alcohol, 1 part of a fluorescent brightner and water were added to 85 parts of Resin A and the mixture was stirred to prepare a coating composition containing 40% solid.

[Formation of an image-receiving layer]

The resultant coating composition was applied on one side of the above base paper by using a gate roll coater in an amount of 4 g/m$^2$ on dry basis, dried and then smoothened by using a soft calender at a nip number of 4, a temperature of the metal roll of 100° C. and a nip linear pressure of 200 kg/cm to prepare a thermal transfer receiving paper having a metric basis weight of 90 g/m$^2$.

EXAMPLE 33

A thermal transfer receiving paper was prepared in the same manner as in Example 32 except that the used amount of Resin A and polyvinyl alcohol was changed to respectively 75 parts and 25 parts to prepare the coating composition of Example 32.

EXAMPLES 34 TO 36

Thermal transfer receiving papers were prepared in the same manner as in Example 21 except that the pulp fibers were changed to Pulp ⑦ (Example 32), Pulp ⑧ (Example 35) and Pulp ⑨ (Example 36), each of which was wet pulp and used in an amount of 90 parts, to prepare the base paper of Example 21.

EXAMPLE 37

A thermal transfer receiving paper was prepared in the same manner as in Example 21 except that 40 parts of LBKP (dry pulp of Pulp ①, CSF 480 ml), 50 parts of LBKP (wet pulp of Pulp ⑦, CSF 480 ml) and 10 parts of NBKP (dry pulp of Pulp ② CSF 500 ml) were used as the pulp fibers to prepare the base paper of Example 21.

Comparative Examples 7 to 11

Thermal transfer receiving papers were prepared in the same manner as in Example 21 except that the synthetic polymer resin was changed to Resin F (Comparative Example 7), Resin G (Comparative Example 8), Resin H (Comparative Example 9), Resin J (Comparative Example 10) and Resin K (Comparative Example 11) to prepare the coating composition of Example 21.

Comparative Example 12

A thermal transfer receiving paper was prepared in the same manner as in Example 21 except that no coating composition was applied on the base paper prepared and the base paper was passed through the super calender as it was.

Comparative Example 13

A thermal transfer receiving paper was prepared in the same manner as in Example 32 except that Resin L was used as the synthetic polymer resin to prepare the coating composition of Example 32.

The qualities of the thermal transfer receiving papers obtained in Examples and Comparative Examples were tested and evaluated by the following methods. The results are shown in Table 3.

(Measurement of image concentration)

A test pattern containing bar code printing, solid printing and dot printing was transferred by using a thermal transfer printer and the density of the black solid printing portion of the resultant image was measured by a Macbeth densitometer (Type RD914 manufactured by Macbeth Co., Ltd.).

(Evaluation of transfer unevenness on the printed surface)

The extent of transfer unevenness in the solid printing portion mentioned above was evaluated macroscopically according to the following criteria.

◎: Excellent with no uneven density nor migration.

○: Good with no substantial uneven density nor substantial migration.

Δ: Somewhat inferior with some uneven density and migration.

X: Inferior with many uneven density and migration.

(Evaluation of sharpness on the printed surface)

The sharpness of the fine line (edge portion) of the above bar code printing was evaluated macroscopically according to the following criteria.

◎: The fine line is sharp and excellent with no dot blotting nor discontinuity of line.

O: The sharpness of the fine line is good with substantially no dot blotting nor discontinuity of line.

Δ: Dot blotting and discontinuity of line are observed and the fine line is unclear and the sharpness is somewhat inferior but there is no practical problem.

X: Many dot blotting and discontinuity of line are observed and the fine line is unclear and the sharpness is inferior.

(Evaluation of dot representativity on the printed surface)

The above dot printing portion was measured by a dot analyzer (DA-3000, manufactured by KS Systems Inc.) by magnify the shape of dots (true circularity) 30 times and the extent of missing of dots were evaluated macroscopically according to the following criteria.

◎: The dot shape is excellent with no missing of dots.

○: The dot shape is good with no substantial missing of dots.

Δ: Missing of dots is observed and the dot shape is somewhat inferior but there is no practical problem.

X: Many missing of dots are observed and the dot shape is inferior.

(Evaluation of staining by rubbing on the printed surface)

The above bar code printing portion was rubber by using a rubbing color fastness tester (manufactured by Toyo Seiki Seisaku-sho, Ltd.) at a load of 200 g 100 times and then the extent of staining was evaluated macroscopically according to the following criteria.

◎: Excellent with no staining in printing.

○: Good with no substantial staining in printing.

Δ: Slightly inferior with some staining in printing.

X: Inferior with remarkable staining in printing.

(Evaluation of printing strength)

Printing was carried out by using an RI printability tester (manufactured by Akira Seisakusho, Ltd.) and evaluated macroscopically according to the following criteria.

◎: Excellent with no pick formation.

○: Good with no substantial pick formation.

Δ: Slightly inferior with pick formation.

X: Inferior with many pick formation.

(Measurement of 10 points-mean surface roughness of the image-receiving layer surface of the receiving paper)

The 10 points-mean surface roughness of the recording layer surface ($R_z$: μm) at a standard length of 8 mm was measured by using a multipurpose surface structure measuring system (SE-3C, manufactured by Kosaka Laboratories Co., Ltd.) according to JIS B-0601.

TABLE 3

| | Image quality | | | | | | 10-pt. |
|---|---|---|---|---|---|---|---|
| | Image density | Transfer unevenness | Sharpness | Dot representativity | Staining by rubbing | Printing strength | mean roughness (μm) |
| Examples | | | | | | | |
| 1 | 1.74 | ◎ | ◎ | ◎ | ◎ | ◎ | 4.7 |
| 2 | 1.75 | ◎ | ◎ | ◎ | ◎ | ○ | 5.6 |
| 3 | 1.73 | ◎ | ◎ | ○ | ◎ | ◎ | 4.9 |
| 4 | 1.69 | ○ | ◎ | ○ | ○ | ◎ | 5.1 |
| 5 | 1.66 | ○ | ○ | ○ | ○ | ○ | 6.3 |
| 6 | 1.72 | ○ | ◎ | ○ | ◎ | ◎ | 4.8 |
| 7 | 1.67 | ○ | ○ | ○ | ○ | ◎ | 6.7 |
| 8 | 1.68 | ○ | ○ | ○ | ◎ | ◎ | 7.5 |
| 9 | 1.71 | ○ | ○ | ○ | ◎ | ◎ | 6.4 |
| 10 | 1.64 | ○ | ○ | ○ | ○ | ◎ | 8.0 |
| 11 | 1.65 | ○ | ○ | ○ | ○ | ○ | 8.9 |
| 12 | 1.72 | ◎ | ◎ | ○ | ◎ | ○ | 5.2 |
| 13 | 1.70 | ◎ | ◎ | ○ | ◎ | ○ | 5.6 |
| 14 | 1.63 | ○ | ○ | ○ | ○ | ◎ | 8.1 |
| 15 | 1.61 | ○ | ○ | ○ | ○ | ◎ | 10.5 |
| 16 | 1.76 | ○ | ○ | ○ | ○ | ◎ | 3.6 |
| 17 | 1.57 | ○ | ○ | ○ | ○ | ◎ | 8.5 |
| 18 | 1.58 | ○ | ○ | Δ | ○ | Δ | 8.1 |
| 19 | 1.51 | ○ | ○ | ○ | ○ | ○ | 9.3 |
| 20 | 1.58 | Δ | Δ | Δ | ○ | ○ | 9.7 |
| Comparative Examples | | | | | | | |
| 1 | 1.62 | Δ | Δ | Δ | Δ | ◎ | 6.4 |
| 2 | 1.63 | Δ | ○ | Δ | ○ | ○ | 5.6 |
| 3 | 1.70 | ○ | Δ | ○ | ○ | Δ | 4.2 |
| 4 | 1.65 | Δ | Δ | Δ | ○ | ○ | 5.9 |
| 5 | 1.59 | Δ | Δ | X | X | ◎ | 6.7 |
| 6 | 1.59 | Δ | Δ | X | Δ | Δ | 8.0 |
| Examples | | | | | | | |
| 21 | 1.68 | ○ | ○ | ○ | ○ | ◎ | 6.2 |
| 22 | 1.65 | ○ | Δ | Δ | ○ | ◎ | 6.6 |
| 23 | 1.66 | ○ | ○ | Δ | ○ | ◎ | 7.0 |
| 24 | 1.62 | ○ | Δ | Δ | ○ | ○ | 6.5 |
| 25 | 1.58 | ○ | Δ | Δ | ○ | ○ | 8.8 |
| 26 | 1.67 | ○ | ○ | ○ | ○ | ○ | 5.7 |
| 27 | 1.65 | ○ | Δ | Δ | ○ | ◎ | 7.1 |
| 28 | 1.61 | ○ | Δ | Δ | ○ | ◎ | 6.4 |
| 29 | 1.56 | ○ | Δ | Δ | ○ | ○ | 7.9 |
| 30 | 1.54 | ○ | Δ | Δ | ○ | ○ | 10.6 |
| 31 | 1.66 | ○ | Δ | Δ | ○ | ◎ | 7.8 |
| 32 | 1.60 | ○ | ○ | ○ | ○ | ○ | 8.3 |
| 33 | 1.55 | ○ | Δ | ○ | ○ | ○ | 8.2 |
| 34 | 1.44 | Δ | ○ | Δ | ○ | ◎ | 10.4 |
| 35 | 1.48 | Δ | Δ | Δ | ○ | ○ | 8.2 |
| 36 | 1.40 | Δ | Δ | Δ | ○ | Δ | 13.3 |
| 37 | 1.47 | Δ | Δ | Δ | ○ | ○ | 8.8 |
| Comparative | | | | | | | |

TABLE 3-continued

| | Image quality | | | | | | 10-pt. |
|---|---|---|---|---|---|---|---|
| | Image density | Transfer unevenness | Sharpness | Dot representativity | Staining by rubbing | Printing strength | mean roughness (μm) |
| Examples | | | | | | | |
| 7 | 1.53 | Δ | Δ | Δ | Δ | ◎ | 8.0 |
| 8 | 1.55 | Δ | Δ | Δ | ○ | ○ | 7.1 |
| 9 | 1.61 | ○ | Δ | ○ | ○ | Δ | 6.7 |
| 10 | 1.59 | Δ | Δ | Δ | ○ | ◎ | 8.5 |
| 11 | 1.50 | Δ | X | X | X | ◎ | 8.9 |
| 12 | 1.38 | X | X | X | Δ | X | 18.3 |
| 13 | 1.46 | X | Δ | X | Δ | ◎ | 8.6 |

As apparent from the results of Table 3, the thermal transfer receiving paper prepared by Examples according to the present invention shows no transfer unevenness nor missing of dots and gives sharp images and is excellent in dot representativity and also has excellent printability and thus can form high image quality.

What is claimed is:

1. A thermal transfer receiving paper in which a coating composition containing a synthetic polymer resin is coated or impregnated on one surface of a base paper containing pulp fibers as the main component to provide an image-receiving layer receiving a thermal melting ink, characterized by that said synthetic polymer resin has a glass transition point of −60° to −5° C. and a surface tension of 38 to 55 dyne/cm.

2. A thermal transfer receiving paper according to claim 1, in which the pulp fibers constituting the base paper contains at least one unbeaten pulp fiber in an amount of 50 to 100 weight % based on the total pulp fibers, which has a degree of water retention of not higher than 125% in accordance with J. TAPPI No. 26, and satisfied the following questions 1 2:

$$0.3 \leqq L \leqq 1.0 \quad 1$$

$$0.3 \leqq d/D \leqq 0.8 \quad 2$$

where

L: Length weighted mean fiber length (mm) measured in accordance with J. TAPPI No. 52

D: Mean fiber diameter (μm) measured by microphotography d: Mean lumen diameter (μm) measured by microphotography.

3. A thermal transfer receiving paper according to claim 1 or 2, in which the image-receiving layer further contains a porous pigment having an apparent specific gravity of 0.1 to 0.5 g/cm$^3$ in accordance with JIS K-6220.

4. A thermal transfer receiving paper according to any of claims 1 to 3, in which the weight ratio of the synthetic polymer resin to the porous pigment contained in the image-receiving layer is 20–150:100.

5. A thermal transfer receiving paper according to any of claims 1 to 3, in which the synthetic polymer resin consists of a synthetic rubber latex.

6. A thermal transfer receiving paper according to claim 3 or 4, in which the coated amount of the coating composition is 5 to 25 g/m$^2$ per one side on dry basis.

7. A thermal transfer receiving paper according to claim 1 or 2, in which the coated amount of the coating composition is 1 to 5 g/m$^2$ per one side on dry basis.

* * * * *